US007114922B2

(12) United States Patent
Tomko et al.

(10) Patent No.: US 7,114,922 B2
(45) Date of Patent: Oct. 3, 2006

(54) TURBINE SHELL JACKING POCKETS

(75) Inventors: Andrew John Tomko, Glenville, NY (US); Dennis William Roberts, Schenectady, NY (US); Jack Nolan, Cobleskill, NY (US)

(73) Assignee: General Electric Company, Schenectady, NY (US)

( * ) Notice: Subject to any disclaimer, the term of this patent is extended or adjusted under 35 U.S.C. 154(b) by 117 days.

(21) Appl. No.: 10/914,096

(22) Filed: Aug. 10, 2004

(65) Prior Publication Data

US 2006/0034678 A1 Feb. 16, 2006

(51) Int. Cl.
*F01D 25/24* (2006.01)

(52) U.S. Cl. ..... 415/214.1; 29/801; 29/252

(58) Field of Classification Search ..... 415/214.1, 415/220; 417/423.14; 29/801, 244, 252
See application file for complete search history.

(56) References Cited

U.S. PATENT DOCUMENTS 2,247,423 A * 7/1941 Webster, Jr. ..... 415/209.2
4,305,192 A * 12/1981 Becker ..... 29/888.02

* cited by examiner

*Primary Examiner*—Ninh H. Nguyen
(74) *Attorney, Agent, or Firm*—Nixon & Vanderhye P.C.

(57) ABSTRACT

A system and method for easily separating upper and lower turbine shells involves forming elongated access pockets vertically aligned across the upper and lower turbine shells and at multiple locations on the turbine shells. Telescoping hydraulic rams are placed into elongated access pockets at each of the multiple locations for lifting the upper shell off of the lower shell. The telescoping hydraulic rams are connected to a controller for controlling each of the rams to operate in parallel with the other rams. Once the turbine shells are separated the upper turbine shell can be removed by conventional block and rigging.

18 Claims, 4 Drawing Sheets

TURBINE SHELL JACKING POCKETS

FIELD OF THE INVENTION

The invention is directed to an apparatus and method for easily separating upper and lower turbine shells from each other to facilitate access to the interior of the turbine. More particularly, the invention involves providing access pockets in both the upper and lower turbine shells to allow for the use of synchronized telescoping hydraulic jacks for uniformly separating the turbine shells. This process makes the separation of the shells and casings quicker and more accurate because the gauling that occurs on the internal radial fits will be greatly minimized.

BACKGROUND OF THE INVENTION

Prior art methods and systems for separating upper and lower turbine shells involve utilizing the rigging art of blocking and jacking in multiple steps to separate the upper and lower turbine shells to the desired distance. Separate jacks have typically been used at, for example, the four corner locations of a turbine and care must be used by the operators of the jacks so that each corner is lifted at the same rate to the same distance. When the ram height of each jack has been extended to nearly its full travel, the turbine shell is blocked firmly in place and the ram is retracted. Next the ram is blocked for its next jacking cycle. This process is repeated 3–4 times depending upon the unit geometry.

FIG. 1 shows upper and lower turbine shells 11 and 12 of turbine 10, and ram access pockets 13 located at the four corners of upper turbine shell 11 (only two ram access pockets are shown). As will be appreciated by those skilled in the art, it is a time consuming and difficult task to ensure that each corner of upper turbine shell 11 is lifted uniformly, at the same rate and for the same distance, away from lower turbine shell 12. Many adjustments are required by the operators during the process to ensure that each jack ram has created the identical level of separation as the other jack rams.

The hydraulic jacking hardware that is typically identified on the wrench and tool list supplied by the turbine manufacturer will only support the above described blocking and jacking process. The pumps and hydraulic rams usually have an effective travel of about 3–4 inches.

Moreover, the typically used manual hydraulic pumps do not have the oil capacity to handle the use of taller telescoping hydraulic cylinders. Also, the access pockets are not tall enough to accommodate the use of larger telescoping rams. Thus, the prior art systems and methods must procure blocking to be used in the step jacking procedure for both the shell and for underneath the ram. This process is labor intensive.

Millwrights working in a team of 8–10 will call out measurements in increments of ⅛ inch until the ram has reached its extended travel. This process is not very accurate for controlling the parallelism of the shell separation. Accordingly, use of prior art systems and methods have frequently caused damage to the radial fits of the turbine shells because of uneven separation of the horizontal joints.

To assist the jacks, a main crane must be hitched to the upper shell to maximize the separating force being applied. The shell is then slowly jacked and lifted until sufficient height is obtained for adjusting the rigging hitch to remove the upper shell. Currently millwrights block and jack the upper half shells about 10–12 inches before they are free of all radial fits. Then they adjust the crane rigging to a level hitch before lifting the shell. When the shell can be positioned free of all the radial fits the hitch levelness is not as critical.

SUMMARY OF THE INVENTION

It has become increasingly important to minimize turbine outage durations. Minimizing the duration of outages by bringing turbines back on line as soon as possible reduces the cost of energy and, in the long run, helps to conserve energy by avoiding the necessity of using more expensive and environmentally dirty methods of energy production in place of turbines.

One way to minimize the length of outages necessitated by turbine maintenance or repair is to more quickly and accurately gain access to the interior of the turbine. Hence, the present invention in which the shell access pockets are made taller without changing the footprint of the turbine. Providing access pockets in the lower half shells in line with the upper half pockets allows the use of synchronized telescoping hydraulic rams to more quickly, accurately and easily separate the turbine shells.

The present invention provides increased control during the separation of the upper and lower turbine shells, and ensures that the upper and lower turbine shells are separated in a parallel process. Moreover, by adding a synchronous lifting system, via the telescoping hydraulic rams, less radial fit damage occurs when the upper shell is removed.

DETAILED DESCRIPTION OF THE INVENTION

Figure 1:
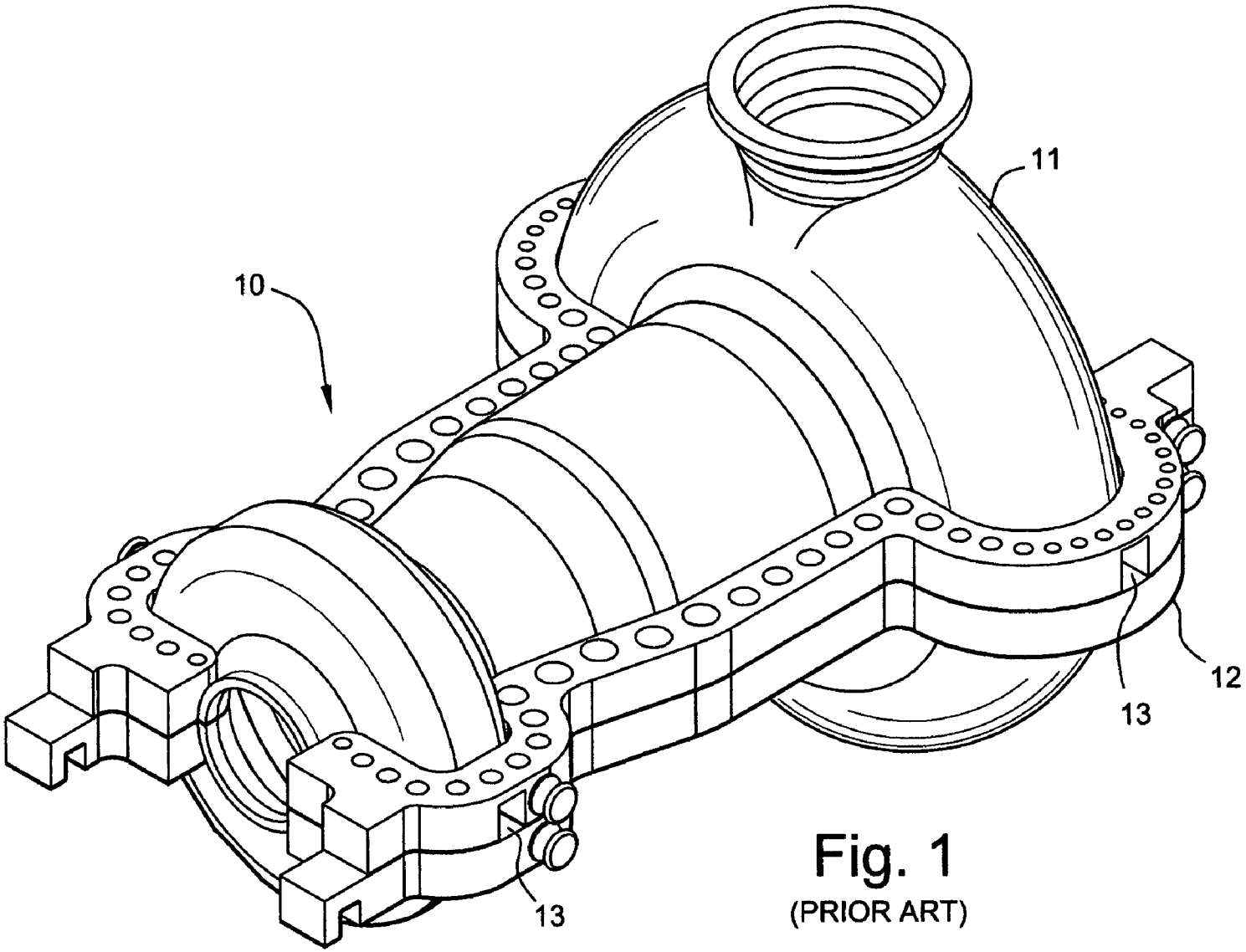
Fig. 1 (PRIOR ART)
FIG. 1 shows prior art turbines having access pockets only in the upper turbine shell.
Figure 2:
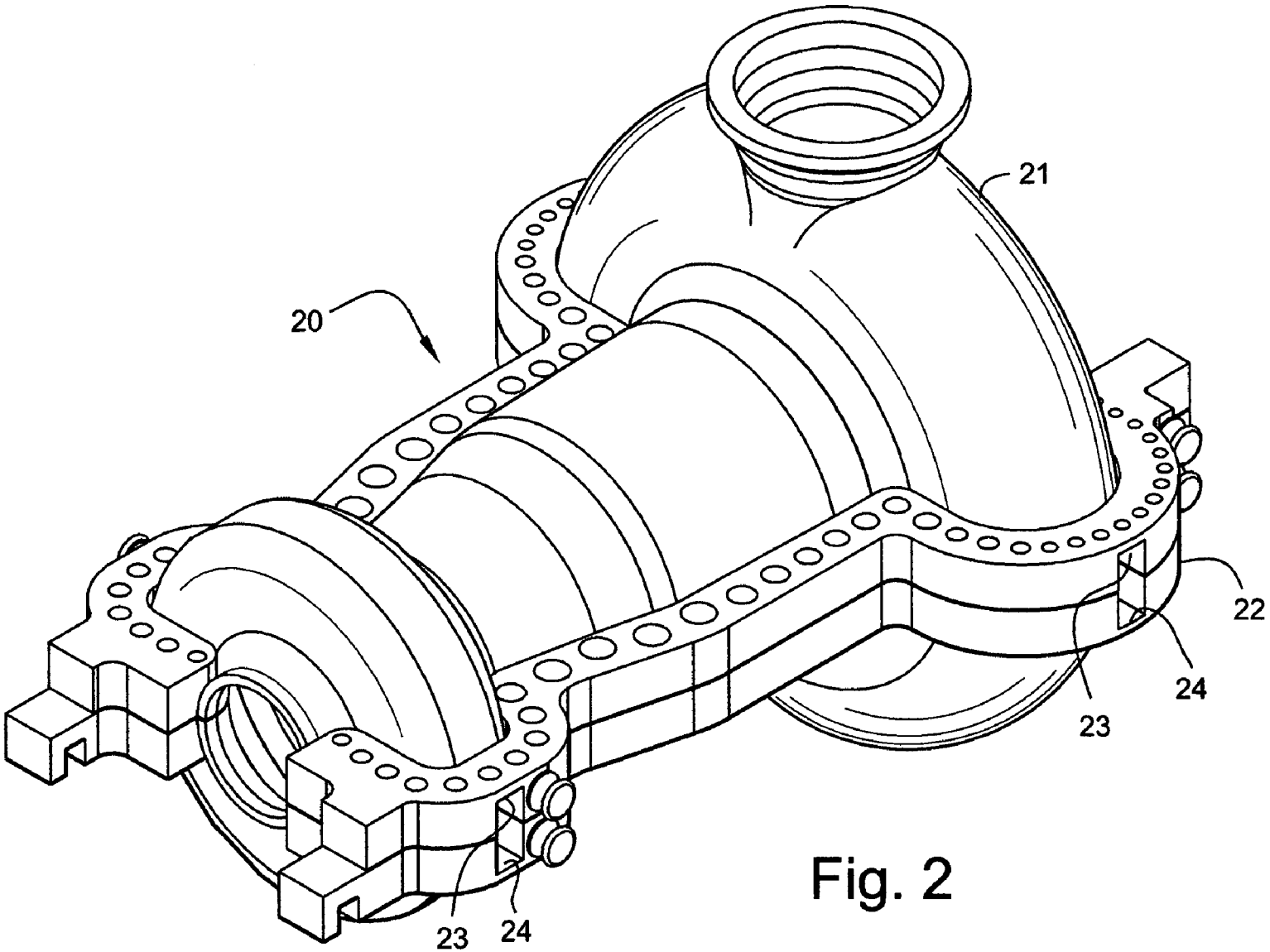
FIG. 2 shows an exemplary embodiment of the present invention to include aligned access pockets in both the upper and lower turbine shells.

As shown in FIG. 2, access pockets 23, 24 are provided in upper and lower turbine shells 21, 22, respectively, of turbine 20. Each pair of access pockets 23, 24 in upper and lower turbine shells 21, 22 are aligned vertically. A pair of access pockets 23, 24 are preferably located at four separate locations on turbine 20. More or less pairs of access pocket locations can be used as long as the locations allow the upper shell to be evenly removed from the lower shell by the block and rigging 31 shown in FIGS. 3 and 4.

Figure 3:
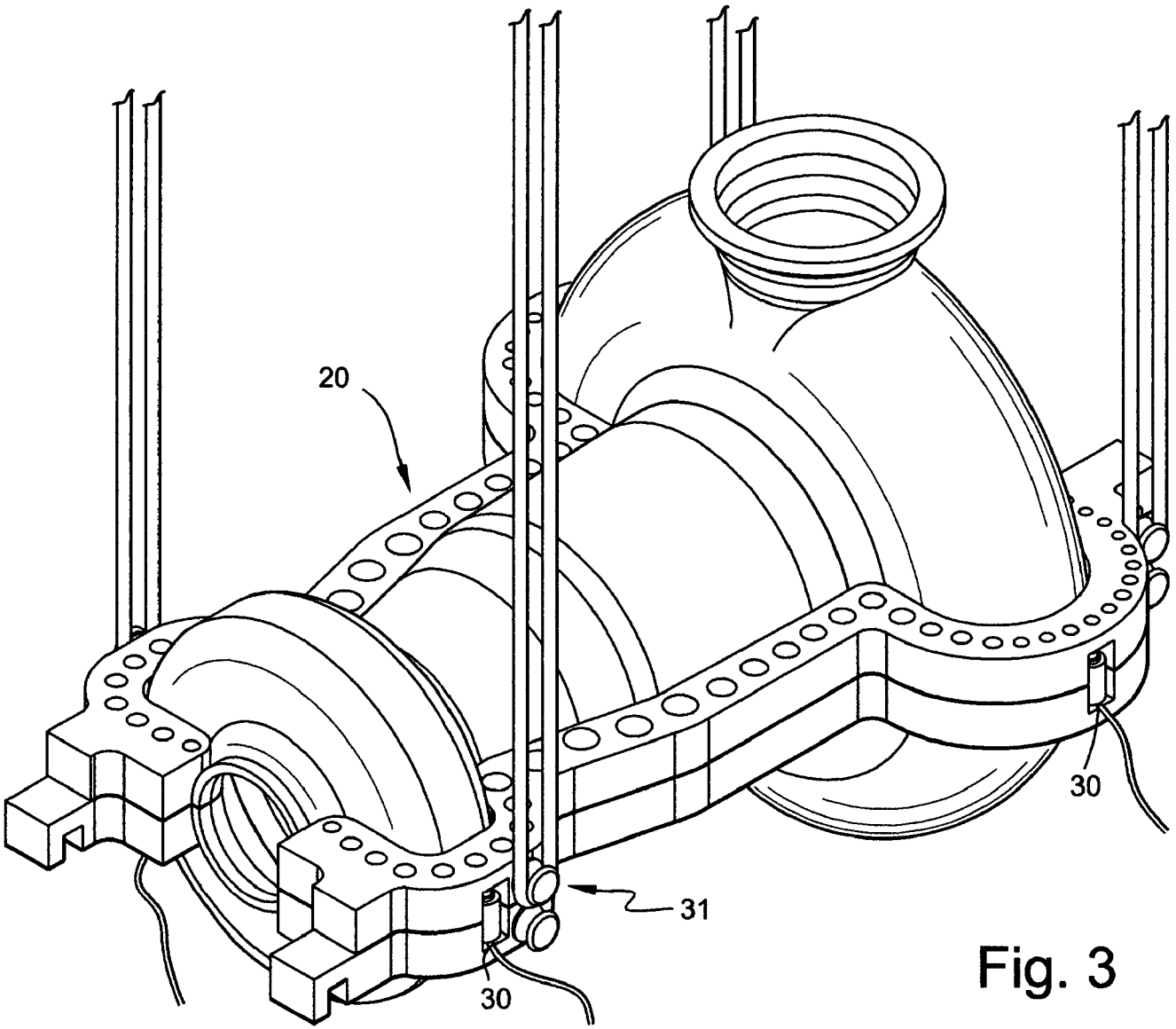
FIG. 3 shows telescoping hydraulic rams disposed in the access pockets shown in FIG. 2.

As shown in FIG. 3, telescoping hydraulic rams 30 are disposed within the upper and lower access pockets 23, 24 in upper and lower turbine shells 21, 22. The rams 30 are used to separate the upper and lower turbine shells or casings. The access pockets 23, 24 are voids that are casted into or machined from the shell or casing material. The purpose of these pockets is to provide a place where ram 30 can be placed to spread the two joining surfaces. The access pockets 23, 24, located in both the upper and lower shells 21, 22 are suitably sized for use with telescoping hydraulic rams 30.

Figure 4:
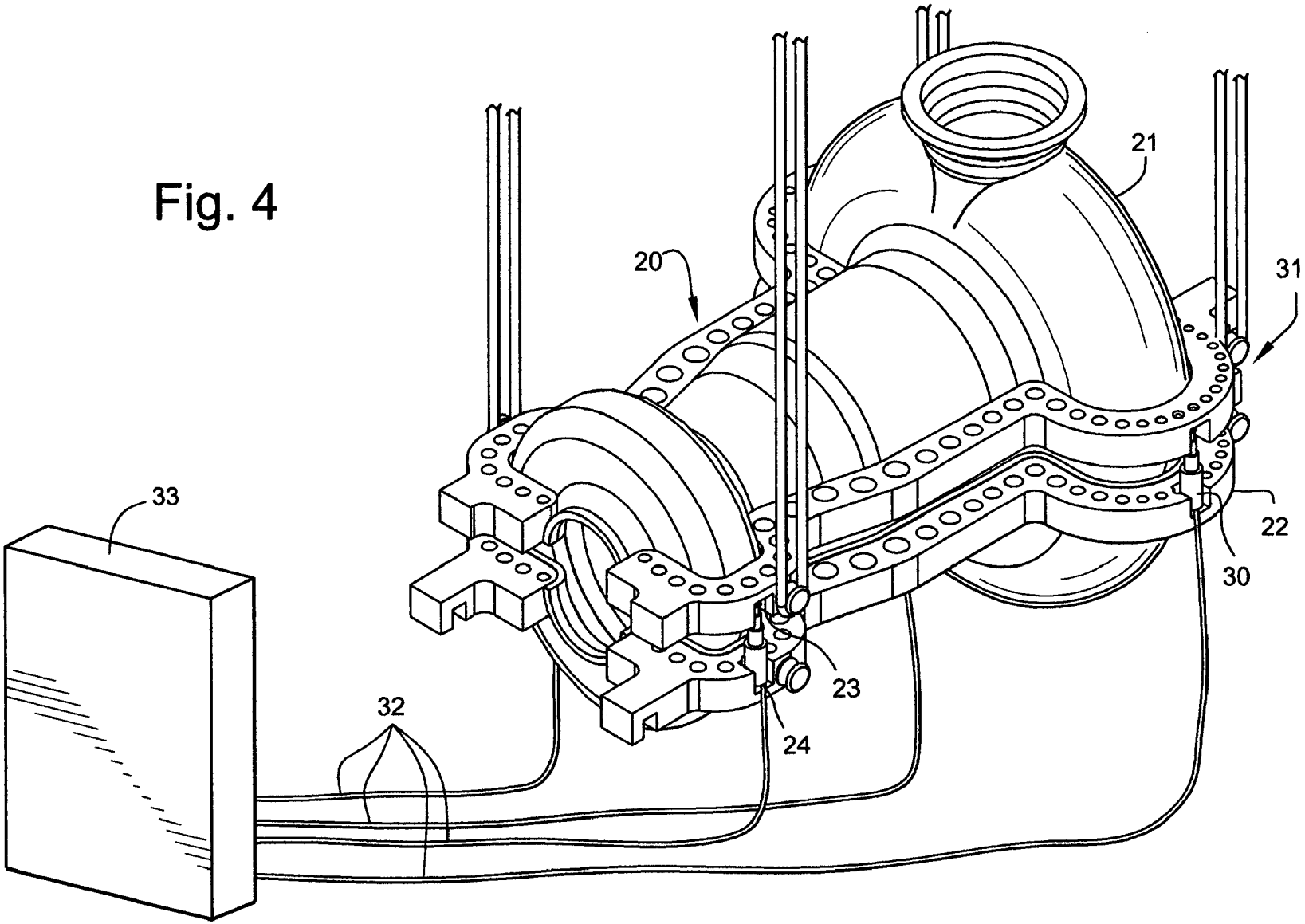
FIG. 4 shows the telescoping hydraulic rams of FIG. 3 controlled in a synchronous manner.

As shown in FIG. 4, the telescoping hydraulic rams 30 are connected via cables 32 to controller 33. Controller 33 controls telescoping hydraulic rams 30 to operate in parallel.

The telescoping hydraulic rams 30, cables 32, and controller 33 can be of the type marketed by Enerpac of Milwaukee, Wis. FIG. 4 shows the rams 30 in their extended state so that upper shell 21 can be easily removed from lower shell 22 by conventional block and rigging 31.

By providing access pockets that can accommodate the use of telescoping hydraulic rams and a synchronous lifting control system, the upper shells and casings can be removed faster and safer. This is accomplished by enlarging and elongating the access pockets without changing the footprint of the turbine.

The application of a synchronizing lifting system used in conjunction with telescoping hydraulic rams minimizes the mechanical gauling that typically occurs on the internal radial fits. This process controls the cocking, jamming and pinching that occurs on close tolerance fits. This added benefit reduces the repair activities after the shell has been separated.

By placing an access pocket in the lower turbine shell in line with an access pocket in the upper turbine shell the height of the vertical opening doubles in size. This enlargement of the access pockets allows for the use of telescoping hydraulic rams capable of more strokes for lifting higher. With the use of telescoping hydraulic rams the shell leveling process can be better controlled and the block and rigging arrangement used to lift off the upper shell or casing becomes less critical. Also, with the use of telescoping rams, a commercially purchased synchronous lifting system can be utilized which makes the jacking processes more accurate than prior art methods and systems.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of separating upper and lower turbine shells from each other, the method comprising:

forming vertically aligned access pockets at multiple locations in the upper and lower turbine shells;

placing a telescoping hydraulic ram within each vertically aligned access pocket; and extending the telescoping hydraulic rams so as to separate the upper and lower turbine shells.

2. The method claimed in claim 1, wherein said vertically aligned access pockets are located at four locations on said upper and lower turbine shells.

3. The method claimed in claim 2, wherein said telescoping hydraulic rams are controlled to extend in parallel.

4. The method claimed in claim 3, further including using block and rigging to remove said upper shell from said lower shell after said upper and lower shells have been separated.

5. The method claimed in claim 2, further including using block and rigging to remove said upper shell from said lower shell after said upper and lower shells have been separated.

6. The method claimed in claim 1, wherein said telescoping hydraulic rams are controlled to extend in parallel.

7. The method claimed in claim 6, further including using block and rigging to remove said upper shell from said lower shell after said upper and lower shells have been separated.

8. The method claimed in claim 1, further including using block and rigging to remove said upper shell from said lower shell after said upper and lower shells have been separated.

9. A system for separating a turbine shell, the system comprising:

an upper turbine shell having access pockets located at multiple locations;

a lower turbine shell having access pockets vertically aligned with said access pockets of said upper turbine shell; and a telescoping hydraulic ram disposed within each vertically aligned access pocket of said upper and lower turbine shells, wherein the telescoping hydraulic rams are extended so as to separate the upper and lower turbine shells.

10. The system claimed in claim 9, wherein said vertically aligned access pockets are located at four locations on said upper and lower turbine shells.

11. The system claimed in claim 10, further including a control system for controlling said telescoping hydraulic rams to extend in parallel.

12. The system claimed in claim 11, further including block and rigging for removing said upper shell from said lower shell after said upper and lower shells have been separated.

13. The system claimed in claim 10, further including block and rigging for removing said upper shell from said lower shell after said upper and lower shells have been separated.

14. The system claimed in claim 9, further including a control system for controlling said telescoping hydraulic rams to extend in parallel.

15. The system claimed in claim 14, further including block and rigging for removing said upper shell from said lower shell after said upper and lower shells have been separated.

16. The system claimed in claim 9, further including block and rigging for removing said upper shell from said lower shell after said upper and lower shells have been separated.

17. A lifting system for a turbine having upper and lower turbine shells, said system including vertically aligned access pockets at multiple locations in the upper and lower turbine shells and a synchronizing lifting system in conjunction with telescoping hydraulic rams disposed within said vertically aligned access pockets for diminishing the mechanical gauling that typically occurs on internal radial fits during separation of the upper and lower turbine shells.

18. The lifting system of claim 17, wherein the vertically aligned access pockets are located at four locations on said upper and lower turbine shells.

* * * * *